US007165793B2

(12) United States Patent
Richmond et al.

(10) Patent No.: US 7,165,793 B2
(45) Date of Patent: Jan. 23, 2007

(54) DOOR JAMB SECURITY PLATE

(76) Inventors: Larry Richmond, 1181 Paddock Rd., Smyrna, DE (US) 19977; Frank Yarrusso, 1181 Paddock Rd., Smyrna, DE (US) 19977

( * ) Notice: Subject to any disclaimer, the term of this patent is extended or adjusted under 35 U.S.C. 154(b) by 82 days.

(21) Appl. No.: 09/968,143

(22) Filed: Oct. 1, 2001

(65) Prior Publication Data

US 2003/0062731 A1 Apr. 3, 2003

(51) Int. Cl.
*E05B 17/00* (2006.01)
*E04B 2/00* (2006.01)
*E05B 15/02* (2006.01)

(52) U.S. Cl. ..... 292/346; 292/340; 292/341.14; 292/341.18

(58) Field of Classification Search ..... 292/340, 292/341.14, 341.18, 341.19, 346, DIG. 53, 292/DIG. 54; 52/287.1, 288.1
See application file for complete search history.

(56) References Cited

U.S. PATENT DOCUMENTS

| | | | | | |
|---|---|---|---|---|---|
| 1,399,897 | A | * | 12/1921 | Singer | 292/346 |
| 1,863,487 | A | * | 6/1932 | Kirkpatrick | 292/346 |
| 2,380,694 | A | * | 7/1945 | Hannon | 292/264 |
| 2,726,112 | A | * | 12/1955 | Conhagen | 292/264 |
| 3,963,269 | A | * | 6/1976 | Rosenberg | 292/346 |
| 4,174,862 | A | * | 11/1979 | Shane | 292/346 |
| 4,547,009 | A | * | 10/1985 | Allen | 292/346 |
| 4,684,160 | A | | 8/1987 | Nelson | |
| 4,690,445 | A | * | 9/1987 | Hartley | 292/341 |
| 4,717,185 | A | * | 1/1988 | Hartley | 292/340 |
| 4,770,452 | A | | 9/1988 | Petree, Jr. | |
| 4,854,621 | A | * | 8/1989 | Baldwin | 292/340 |
| 4,862,658 | A | | 9/1989 | Barker et al. | |
| 4,887,856 | A | * | 12/1989 | Percoco et al. | 292/337 |
| 4,993,764 | A | * | 2/1991 | Barker | 292/340 |
| 5,014,527 | A | | 5/1991 | Traller et al. | |
| 5,024,475 | A | | 6/1991 | Francis | |
| 5,031,946 | A | * | 7/1991 | Yarrow | 292/337 |
| 5,070,650 | A | * | 12/1991 | Anderson | 49/460 |
| 5,074,606 | A | * | 12/1991 | Priola et al. | 292/346 |
| 5,241,790 | A | | 9/1993 | Schimpf | |
| 5,280,976 | A | | 1/1994 | Melyon | |
| 5,427,422 | A | * | 6/1995 | Madlener et al. | 292/264 |
| 5,528,915 | A | * | 6/1996 | Percoco | 70/416 |
| 5,566,509 | A | | 10/1996 | Long | |
| 5,566,995 | A | | 10/1996 | Jagiela | |

(Continued)

FOREIGN PATENT DOCUMENTS

GB 658035 * 10/1951

*Primary Examiner*—Brian E. Glessner
*Assistant Examiner*—Carlos Lugo
(74) *Attorney, Agent, or Firm*—RatnerPrestia

(57) ABSTRACT

A reinforcing plate comprising an elongated portion adapted to be secured to a door jamb; a plurality of tabs perpendicular to the door jamb and adapted to be secured to one or more studs adjacent the door jamb; and an L-shaped connecting portion between each tab and the elongated portion. Each L-shaped portion comprises a first spacer in a plane parallel to the tabs and a second spacer having a depth essentially equivalent to a distance between the mounting surface of the wall studs and a finished wall surface in a fourth plane parallel to the jamb. The reinforcing plate further comprises at least one component for interfacing with a securing element attached to a door mounted in the door opening.

18 Claims, 3 Drawing Sheets

U.S. PATENT DOCUMENTS 5,581,948 A * 12/1996 Simonsen ..... 49/460
5,737,878 A 4/1998 Raulerson et al.
5,845,433 A 12/1998 Walsh
5,934,024 A 8/1999 Simpson
5,992,100 A 11/1999 Sidney
6,036,239 A 3/2000 Hammersley
6,085,465 A 7/2000 Olberding et al.
6,178,700 B1 1/2001 Mayer, Jr.
6,338,229 B1 * 1/2002 Botzen ..... 52/371

* cited by examiner

DOOR JAMB SECURITY PLATE

TECHNICAL FIELD

This invention relates to security devices, specifically reinforcements for door jambs to prevent forcible entry.

BACKGROUND OF THE INVENTION

Although consumers may often turn to steel entry doors to try to increase the security of their homes or businesses, the steel door is only as secure as the door frame into which it is installed. Often, doors are purchased in a pre-hung form. The door jambs on pre-hung doors may comprise pine, which is not a particularly strong type of wood for preventing forcible entry. Thus, unless the steel door is hung in a reinforced door frame, the overall security of the entry is not increased by the purchase of a steel door, because the door jamb may merely become the weakest link in preventing forcible entry.

Therefore, there is a need in the art for a relatively inexpensive way to reinforce a door jamb.

SUMMARY OF THE INVENTION

One aspect of the invention comprises a door jamb reinforcing plate. The reinforcing plate comprises an elongated portion adapted to be secured to the door jamb in a first plane in the passageway from an exterior wall to an interior wall formed by the door opening. The reinforcing plate also comprises at least one tab in a second plane perpendicular to the first plane and adapted to be secured to a mounting surface of one or more wall studs adjacent to the door jamb. The reinforcing plate further comprises at least one L-shaped connecting portions between each tab and the elongated portion. Each L-shaped portion comprises a first spacer in a third plane parallel to the second plane, and a second spacer in a fourth plane parallel to the first plane. The second spacer has a depth essentially equivalent to a distance between the mounting surface of the one or more wall studs and a finished wall surface over the wall studs. The reinforcing plate further comprises at least one means for interfacing with an element attached to a door mounted in the door opening. The L-shaped connecting portion second spacer may have a width adapted to accommodate a standard available sheetrock width.

The means for interfacing with an element attached to the door may comprise, for example, a peek chain flange with a peek chain attached thereto, a dead bolt receiving opening, and/or a plunger bolt receiving opening in any combination. The reinforcing plate may comprises steel, preferably steel at least about ⅛ inch thick.

In one aspect of the invention, the elongated portion and each of the tabs have a plurality of fastener holes; each L-shaped portion has a depth adapted to accommodate a standard available sheetrock width; and the means for interfacing with door comprise at least a peek chain flange with a peek chain attached thereto, wherein the reinforcing plate comprises steel having a thickness of at least ⅛ of an inch. The reinforcing plate may further comprise a dead bolt receiving opening, a plunger receiving opening, or both.

Another aspect of the invention comprises a door frame comprising the reinforcing plate as described herein. Yet another aspect comprises a method of reinforcing a door jamb, comprising installing the reinforcing plate of this invention, the method comprising fastening the reinforcing plate tabs to the wall studs adjacent the door jamb; fastening the elongated portion to the door jamb in the passageway; and installing the finished wall over the wall studs and the tabs.

DETAILED DESCRIPTION OF THE INVENTION

The invention will next be illustrated with reference to the figures wherein the same numbers indicate similar elements in all figures. Such figures are intended to be illustrative rather than limiting and are included herewith to facilitate the explanation of the apparatus of the present invention.

Figure 1:
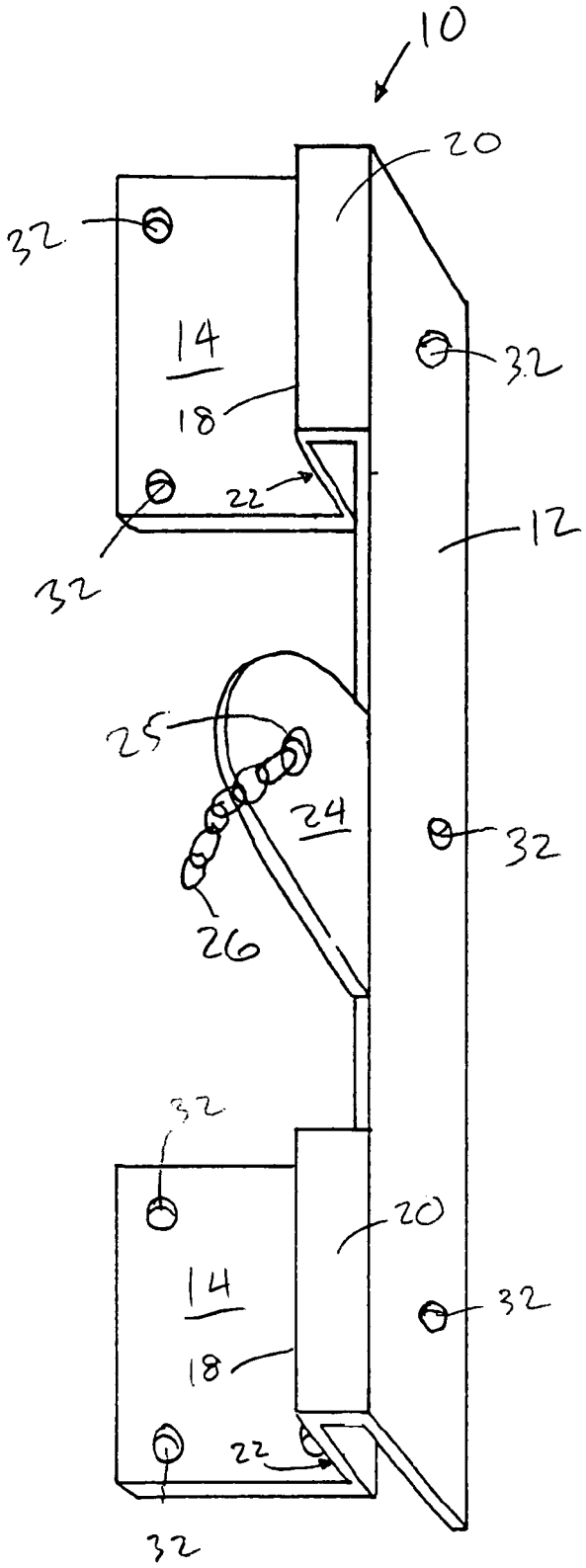
FIG. 1 is a perspective view illustration of an embodiment of the invention having a peek chain interface.

Referring now to FIGS. 1, there is shown an exemplary reinforcing plate 10 in accordance with the invention. The reinforcing plate comprises an elongated portion 12 adapted to be secured to the door jamb 11 in a first plane A (shown in FIGS. 4 and 5), in the passageway 13 from an exterior wall (not shown) to an interior wall 15 created by a door opening. As used herein, the terms "interior" and "exterior" refer merely to the direction in which the door opens. The interior is the side of the wall toward which the door opens, wherein the exterior is the opposite side of the wall. Thus, the interior as referred to herein is not necessarily the same as the interior of an enclosure to which the door leads. Reinforcing plate 10 also comprises two tabs 14, each in a second plane B perpendicular to plane A, adapted to be secured to a mounting surface 17 of one or more wall studs 16 adjacent to door jamb 11. An L-shaped connecting portion 18 connects each tab 14 with elongated plate 12.

L-shaped portion 18 comprises a first spacer 20 in a third plane C parallel to the plane B, and a second spacer 22 in a fourth plane D parallel to the plane A and having a depth z essentially equivalent to the distance d between the mounting surface of the wall studs 16 and finished wall surface 15 over the wall studs. Depth z is preferably sufficient to accommodate a thickness of standard available sheetrock 30. Sheetrock is typically available in ¼ inch, ½ inch, and ⅝ inch thicknesses, with ½ inch being most commonly used size. For marketing purposes, therefore, a plurality of reinforcing plates may be made available to accommodate each commonly available sheetrock thickness. By "accommodate" it is meant that the sheetrock can be mounted over tabs 14 so that the interior wall surface 15 is flush or nearly flush with spacer 20. Thus, for example, for ½ inch sheetrock, dimension z is typically about ½ inch. The length of spacer 20 between elongated portion 12 and spacer 22 is sufficient to allow the plate to wrap around a standard thickness of wood used for door jamb 11. Typically, for a pre-hung door, this width is approximately ⅝ inch, but the invention is not limited to any particular thickness. It should be noted that the relative thicknesses shown in FIGS. 4 and 5 are not to scale.

Reinforcing plate 10 further comprises a peek chain flange 24 with a peek chain 26 attached thereto. Peek chain flange 24 is merely one type of the various means that may be a part of a reinforcing plate of this invention for interfacing with an element attached to the door (not shown) to be mounted in the door opening.

Figure 2:
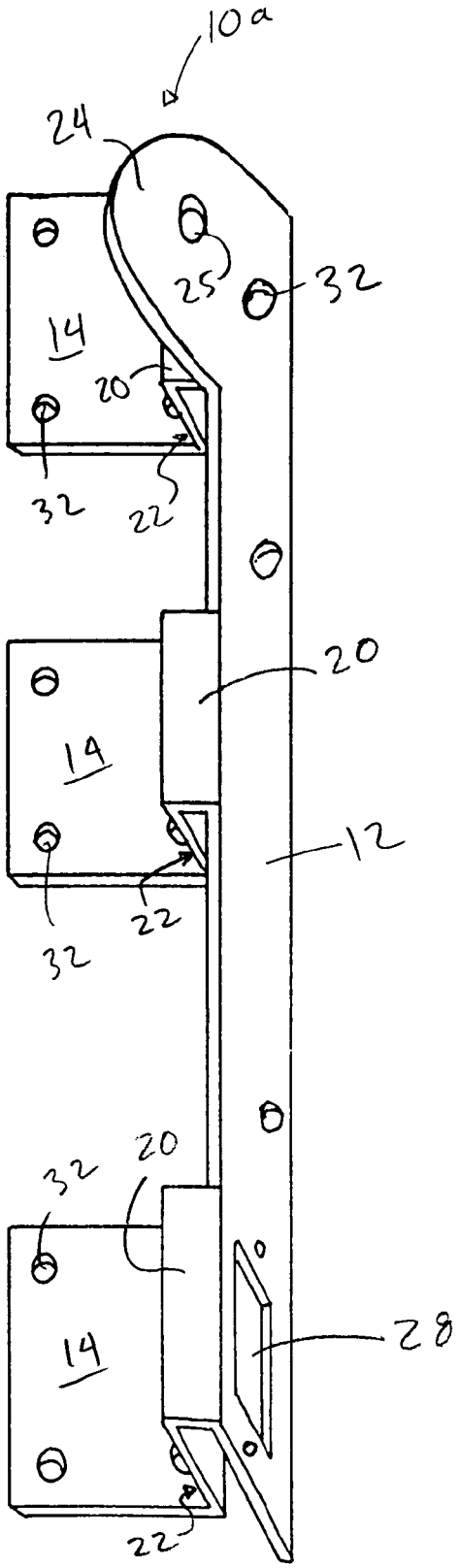
FIG. 2 depicts a perspective view illustration of an embodiment having both a peek chain interface and a dead-bolt receiving interface.
Figure 3:
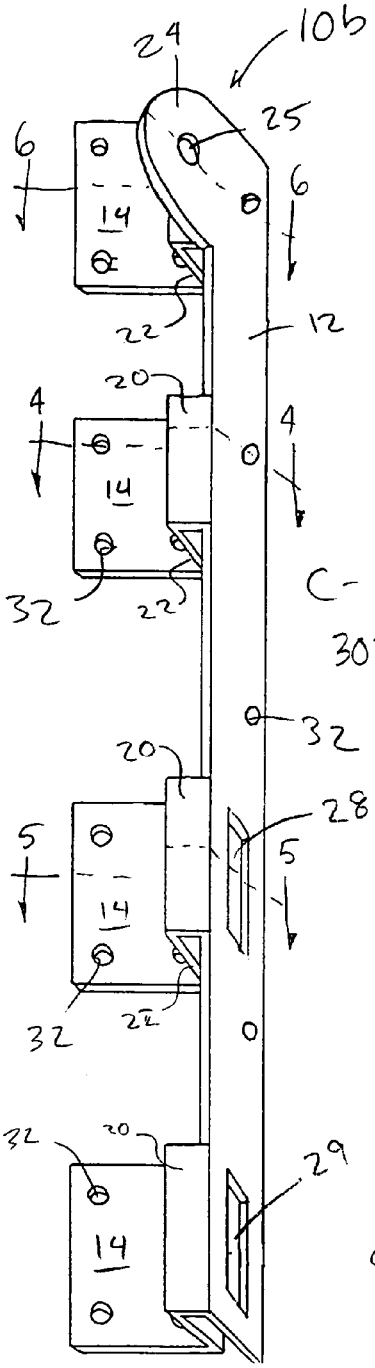
FIG. 3 depicts a perspective view illustration of an embodiment having a peek chain interface, a dead-bolt receiving interface, and a plunger bolt receiving interface.
Figure 5:
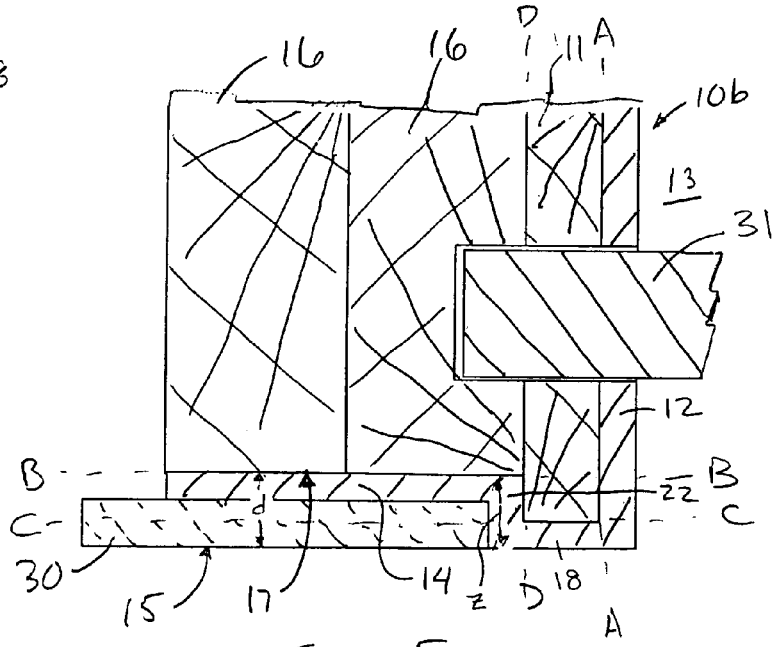
FIG. 5 is a cross-sectional illustration of the embodiment of FIG. 3 installed in a door opening, taken across section line 5—5.

The means for interfacing with the door may comprise a dead bolt receiving opening 28 for receiving a deadbolt 31 such as shown in FIGS. 2, 3 and 5, and/or a plunger bolt receiving opening 29 as shown in FIG. 3. A strike plate (not shown) is typically provided in or over opening 29, as is known in the art. Accordingly, plate 10*b* may include means for affixation of a standard strike plate, such as tabs with screw holes or any other equivalent means. As shown in FIG. 2, reinforcing plate 10*a* comprises both the peek change flange 24 and dead bolt receiving opening 28, whereas plate 10*b* in FIG. 3 shows all three of the peek chain flange 24, dead bolt receiving opening 28, and plunger bolt receiving opening 29. Reinforcing plates of this invention may comprise any combination of one or more of these means for interfacing with the door, including combinations of any two of the means. Any other means known in the art for attaching to a door may also be incorporated in the design of the reinforcing plate of this invention. Such means include other locking interfaces as well as hinge interfaces (not shown) for reinforcing the hinge side of the door. As used herein, the term "door jamb" refers to any portion of the door frame surrounding the door opening in which a door may be hung.

Figure 4:
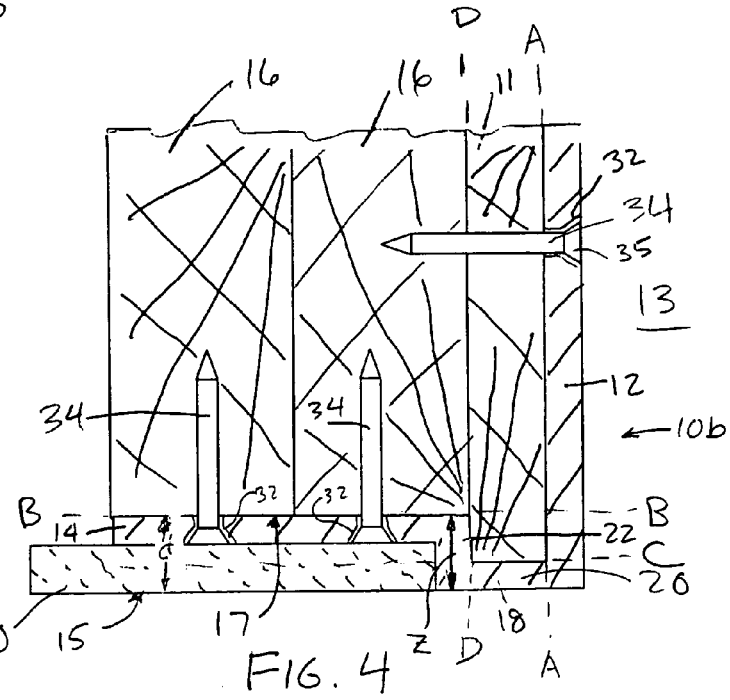
FIG. 4 is a cross-sectional illustration of the embodiment of FIG. 3 installed in a door opening, taken across section line 4—4.

Although shown in FIGS. 4 and 5 with tabs 14 attached to interior surface 17 of wall studs 16, an embodiment (not shown) may also be provided wherein tabs 14 attach to the exterior surface (not shown) of the wall studs, so that spacer 22 runs between jamb 11 and the adjacent stud 16. Such an embodiment may provide additional resistance to forcible entry, but requires a more complicated installation process, preferably requiring installation simultaneously with installing the door jamb. The embodiments shown in FIGS. 1–5 have the advantage of allowing installation after a door and door jamb, such as a pre-hung door assembly, has already been installed.

Figure 6:
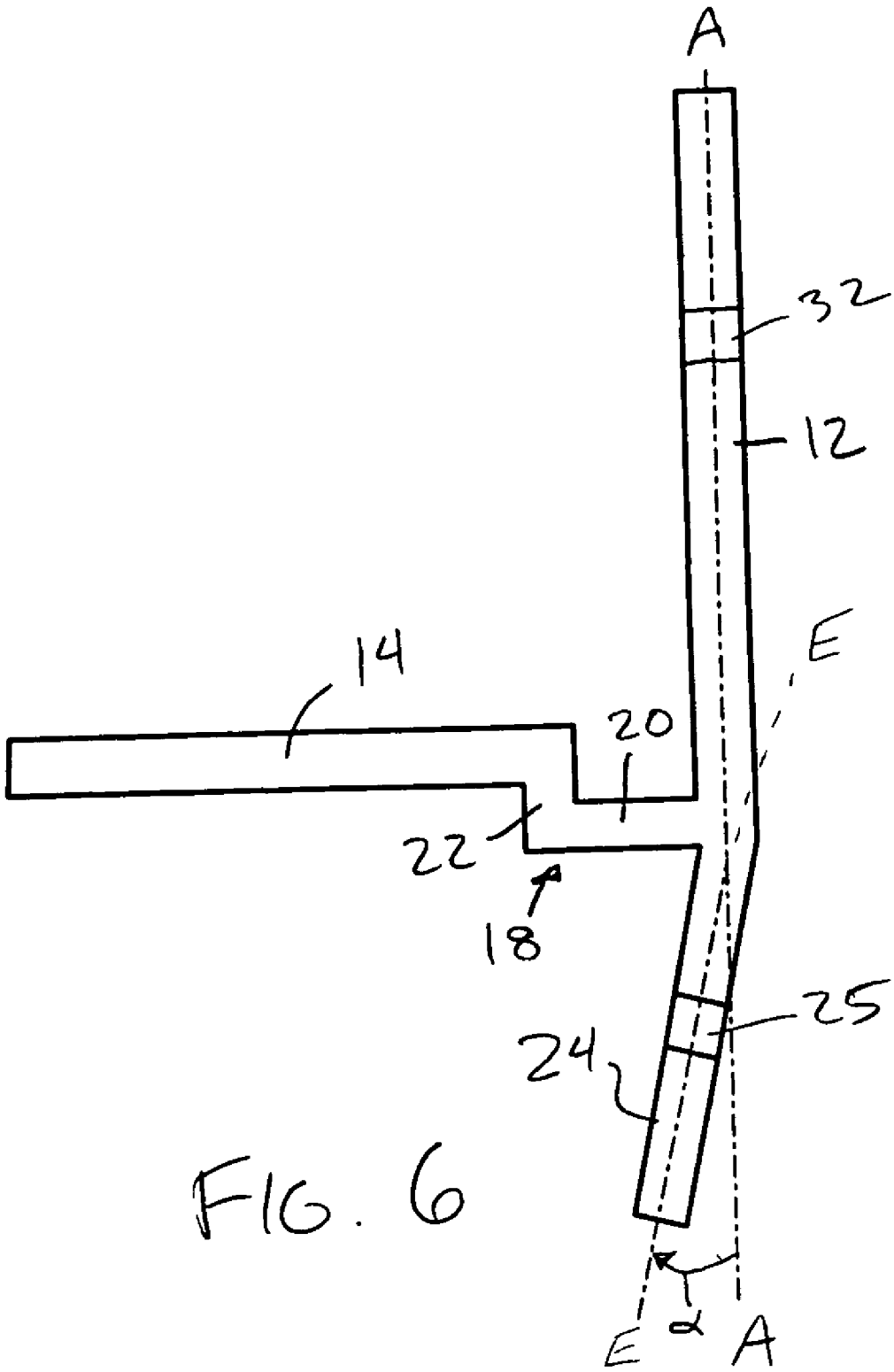
FIG. 6 is a cross-sectional illustration of the embodiment of FIG. 3 taken across section line 6—6.

As shown in FIG. 6, peek chain flange 24 may extend from the first elongated portion along a plane E rotated from plane A at an angle ∀ of between 5° and 45°, preferably approximately 10°, counterclockwise as viewed from atop the door. The peek chain flange orientation is not limited, however, to any particular angle of rotation or particular structure. Furthermore, although shown in FIG. 1 with peek chain 26 attached through hole 25 in flange 24, the structure of the peek chain interface is not limited to any particular means for affixing the chain to the flange. In fact, the term "peek chain flange" as used herein refers to any structure to which a peek chain may be attached, the term "peek chain" referring to any chain or other means known in the art that may be removably secured to a door to allow the door to open only slightly so as to allow an occupant to open the door enough to "peek" through the crack created by the slightly open door. The term "peek chain" also refers to any similar means that when removably attached to the door does not allow the door to open far enough to create a crack through which one can peek. The peek chain itself is not shown in FIGS. 2, 3, and 6 for simplicity.

The reinforcing plate preferably comprises steel, more preferably steel that is at least about ⅛ inch thick. Any metal of any thickness may also be used, however, as may non-metals, such as composites, having sufficient strength to prevent forcible entry.

The reinforcing plate may typically comprise a plurality of fastener holes 32 in elongated portion 12 and in each of tabs 14, through which fasteners, such as screws 34, may be affixed for securing the plate to the jamb and the studs. The holes 32 may have a cross-sectional geometry, as known in the art, to allow the screw heads 35 to be countersunk as shown in FIG. 4.

The reinforcing plates shown in FIGS. 1–3 comprise at least two tabs 14, but may have only one tab or more than two tabs depending on the structure of the tabs and the relative length of elongated portion 12. More tabs are typically provided for longer plates. For example, plate 10 shown in FIG. 1 having only the peek chain interface has only two tabs 14, whereas plate 10*a* shown in FIG. 2 with both the peek chain interface and the dead bolt receiving opening 28 has three tabs, and plate 10*b* shown in FIG. 3 extending to a plunger bolt receiving opening 29, has four tabs. The number of tabs, however, are not limited to the examples provided. In fact, although the use of discrete tabs is preferred to lower the overall weight and cost of the reinforcing plate, a single tab 14, such as but not limited to a tab coextensive with the elongated portion or some significant portion thereof, may be used.

The invention includes not only the reinforcing plates as described herein, but any door frame that frames a door opening in which a reinforcing plate as described herein has been installed. The invention also comprises a method of reinforcing a door jamb using any of the reinforcing plates described herein. The method of reinforcing the door comprises fastening the reinforcing plate tabs 14 to wall studs 16 adjacent door jamb 11 as shown in FIGS. 4 and 5, fastening elongated portion 12 to the door jamb in passageway 13; and then installing finished wall 30 over the wall studs and the tabs.

While the present invention has been described with respect to specific embodiments thereof, it is not limited thereto. Therefore, the claims that follow are intended to be construed to encompass not only the specific embodiments described but also all modifications and variants thereof which embody the essential teaching thereof.

What is claimed is:

1. A single-piece door jamb reinforcing plate for a door opening that forms a passageway from a first wall surface to a second wall surface, the reinforcing plate comprising:

an elongated portion adapted to be secured to a surface of the door jamb exposed to the passageway in a first plane;

at least one tab in a second plane perpendicular to the first plane and having an inner surface and an outer surface, the at least one tab adapted to be secured to one or more wall studs adjacent to the door jamb and the second wall, with the inner surface of the at least one tab facing the one or more wall studs;

at least one L-shaped connecting portion between the at least one tab and the elongated portion, the L-shaped portion comprising a first spacer in a third plane parallel to the second plane and adapted to he mounted adjacent the second wall surface, and a second spacer in a fourth plane parallel to the first plane, the second spacer having a depth sufficient to accommodate a finished wall member over the outer surface of the at least one tab and shorter than a depth of the elongated portion, the L-shaped connecting portion and the elongated portion together comprising a three-sided pocket for receiving an edge of the door jamb adjacent the second wall surface; and at least one means for interfacing with an element attached to a door mounted in the door opening, the at least one means comprising a peek chain flange with a peek chain attached thereto.

2. The reinforcing plate of claim 1, wherein the peek chain flange extends from the elongated portion along a plane rotated from the first plane at an angle between 5° and 45° counterclockwise as viewed from atop the door.

3. The reinforcing plate of claim 2, wherein the angle is approximately 10°.

4. The reinforcing plate of claim 1, wherein the means for interfacing with the door comprises a dead bolt receiving opening.

5. The reinforcing plate of claim 1, wherein the means for interfacing with the door comprises a plunger bolt receiving opening.

6. The reinforcing plate of claim 1, wherein the means for interfacing with the door comprises at least two of a peek change flange with a peek chain attached thereto, a dead bolt receiving opening, and a plunger bolt receiving opening.

7. The reinforcing plate of claim 1, wherein the plate comprises steel.

8. The reinforcing plate of claim 7, wherein the steel is at least about ⅛ inch thick.

9. The reinforcing plate of claim 1, wherein the depth of the L-shaped connecting portion second spacer is sufficient to accommodate a thickness of sheetrock as the finished wall member.

10. The reinforcing plate of claim 1 further comprising a plurality of fastener holes in the first elongated portion and a plurality of fastener holes in the at least one tab.

11. The reinforcing plate of claim 1, wherein the reinforcing plate comprises two tabs.

12. The reinforcing plate of claim 11, wherein the interfacing means further comprises a dead bolt receiving opening and the plate further comprises a third tab.

13. The reinforcing plate of claim 12, wherein the interfacing means further comprises a plunger bolt opening and the plate further comprises a fourth tab.

14. A reinforcing plate of claim 1, wherein:

the elongated portion comprises a plurality of fastener holes;

the at least one tab has a plurality of fastener holes;

the second spacer depth is sufficient to accommodate a thickness of sheetrock; and the reinforcing plate comprises steel having a thickness of at least ⅛ of an inch.

15. The reinforcing plate of claim 14 further comprising a dead bolt receiving opening, a plunger receiving opening, or both.

16. The reinforcing plate of claim 1, wherein the reinforcing plate is installed in a door frame around a door opening that forms a passageway from an exterior wall to an interior wall.

17. A method of reinforcing a door jamb in a door opening that forms a passageway from an exterior wall to an interior wall, the method comprising installing a reinforcing plate, the reinforcing plate comprising an elongated portion adapted to be secured to a surface of the door jamb exposed to the passageway in a first plane; at least one tab in a second plane perpendicular to the first plane and adapted to be secured to a mounting surface of one or more wall studs adjacent to the door jamb; at least one L-shaped connecting portion between the at least one tab and the elongated portion, the L-shaped portion comprising a first spacer in a third plane parallel to the second plane and adjacent the interior wall, and a second spacer in a fourth plane parallel to the first plane, the second spacer having a depth essentially equivalent to a distance between the mounting surface of the one or more wall studs and a surface of a finished wall over the wall studs, the second spacer depth shorter than a depth of the elongated portion, the L-shaped connecting portion and the elongated portion together comprising a three-sided pocket to receive an edge of the doorjamb adjacent the interior wall, and; and at least one means for interfacing with an element attached to a door mounted in the door opening, the at least one means comprising a peek chain flange with a peek chain attached thereto; the method comprising:

(a) fastening the at least one tab to the wall studs adjacent the door jamb;

(b) fastening the elongated portion to the door jamb in the passageway;

(c) installing the finished wall over the wall studs and the at least one tab.

18. A door jamb reinforcing plate for attachment to and reinforcement of a door jamb of a door in a door opening that forms a passageway from a first wall surface to a second wall surface, the door jamb having an outer surface exposed to the passageway, the fixture comprising a single-piece construction consisting essentially of:

an elongated portion adapted to be secured to the outer surface of the door jamb in a first plane;

at least one tab in a second plane perpendicular to the first plane, the at least one tab having an inner surface and an outer surface, the at least one tab adapted to be secured to one or more wall studs adjacent to the door jamb and the second wall surface, with the at least one tab inner surface facing the one or more wall studs;

at least one connecting portion between the at least one tab and the elongated portion, the connecting portion and the elongated portion together comprising a three-sided pocket for receiving an edge of the door jamb adjacent the second wall, the connecting portion comprising a spacer connected to the tab having a depth sufficient to accommodate a finished wall member over the at least one tab outer surface, and shorter than a depth of the elongated portion; and at least one means for interfacing with an element attached to a door mounted in the door opening, the at least one means comprising a peek chain flange with a peek chain attached thereto.

* * * * *